US008402865B2

(12) United States Patent
Lin

(10) Patent No.: US 8,402,865 B2
(45) Date of Patent: Mar. 26, 2013

(54) HAND TOOL

(75) Inventor: Jack Lin, Taichung (TW)

(73) Assignee: Yih Cheng Factory Co., Ltd., Taichung (TW)

( * ) Notice: Subject to any disclaimer, the term of this patent is extended or adjusted under 35 U.S.C. 154(b) by 238 days.

(21) Appl. No.: 12/939,005

(22) Filed: Nov. 3, 2010

(65) Prior Publication Data

US 2012/0103143 A1 May 3, 2012

(51) Int. Cl.

| | |
|---|---|
| ***B25B 23/16*** | (2006.01) |
| ***B25G 1/06*** | (2006.01) |
| *B25B 15/04* | (2006.01) |

(52) U.S. Cl. ..... 81/177.9; 81/177.8

(58) Field of Classification Search ..... 81/177.9, 81/177.8

See application file for complete search history.

(56) References Cited

U.S. PATENT DOCUMENTS

| | | | | |
|---|---|---|---|---|
| 2,068,207 | A * | 1/1937 | Torbert, Jr. | 81/177.9 |
| 5,069,091 | A * | 12/1991 | Bramsiepe et al. | 81/177.7 |
| 6,386,075 | B1 * | 5/2002 | Shiao | 81/177.8 |
| 6,520,053 | B2 * | 2/2003 | Liao | 81/177.9 |
| 6,745,480 | B1 * | 6/2004 | Liao | 30/519 |
| 7,287,450 | B1 * | 10/2007 | Liao | 81/177.9 |
| 7,905,163 | B1 * | 3/2011 | Chiang | 81/177.9 |
| 2008/0121074 | A1 * | 5/2008 | Hu | 81/177.8 |

* cited by examiner

*Primary Examiner* — David B Thomas

(57) ABSTRACT

A hand tool includes a handle, a shank pivotally connected to the handle, and a locking unit operable for retaining the shank in a selected one of first and second angles relative to the handle. The first angle is about 175° to 185°, wherein the second angle is about 115° to 145°.

4 Claims, 3 Drawing Sheets

HAND TOOL

BACKGROUND OF INVENTION

1. Field of Invention

The present invention relates to a hand tool and, more particularly, to a hand tool including pivotally connected handle and shank.

2. Related Prior Art

As disclosed in Taiwanese Patent Publication No. 232864, a conventional hand tool includes a handle 10, a detent 20 located in the handle 10 movably, a spring 25 for biasing the detent 20, a shank 30 connected to the handle 10 pivotally, and a bit 40 connected to the shank 30 detachably. The handle 10 includes a gap 11 defined between two ears 12 extending from an end. The detent 20 includes an enlarged portion 23 formed thereon. The spring 25 is compressed between a portion of the handle 10 and the enlarged portion of the detent 20 for retaining the detent 20 in a locking position. The shank 30 includes a semicircular portion 33 formed thereon and a semicircular ridge 34 extending on the semicircular portion 33. There are recesses 35 defined in the semicircular ridge 34. In the locking position, the enlarged portion 23 of the detent 20 is located in a selected one of the recesses 35, thus retaining the shank 30 at a selected one of several angles relative to the handle 10. The detent 20 is movable to a releasing position wherein the enlarged portion 23 of the detent 20 is located out of the recesses 35, thus allowing the pivotal of the shank 30 relative to the handle 10. There are problems with the use of the conventional hand tool. At first, it takes quite some time for a user to set the shank 30 in a desired angle relative to the handle 10 since there are too many angles corresponding to the recesses 35 and some of them are redundant. Secondly, the user might get hurt by tooth-like portions of the semicircular ridge 34 between the recesses 35 since the semicircular ridge 34 extends from the circular portion 33 of the shank 30.

The present invention is therefore intended to obviate or at least alleviate the problems encountered in prior art.

SUMMARY OF INVENTION

It is the primary objective of the present invention to provide an efficient hand tool.

To achieve the foregoing objective, the hand tool includes a handle, a shank pivotally connected to the handle, and a locking unit operable for retaining the shank in a selected one of first and second angles relative to the handle. The first angle is about 175° to 185°, wherein the second angle is about 115° to 145°.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
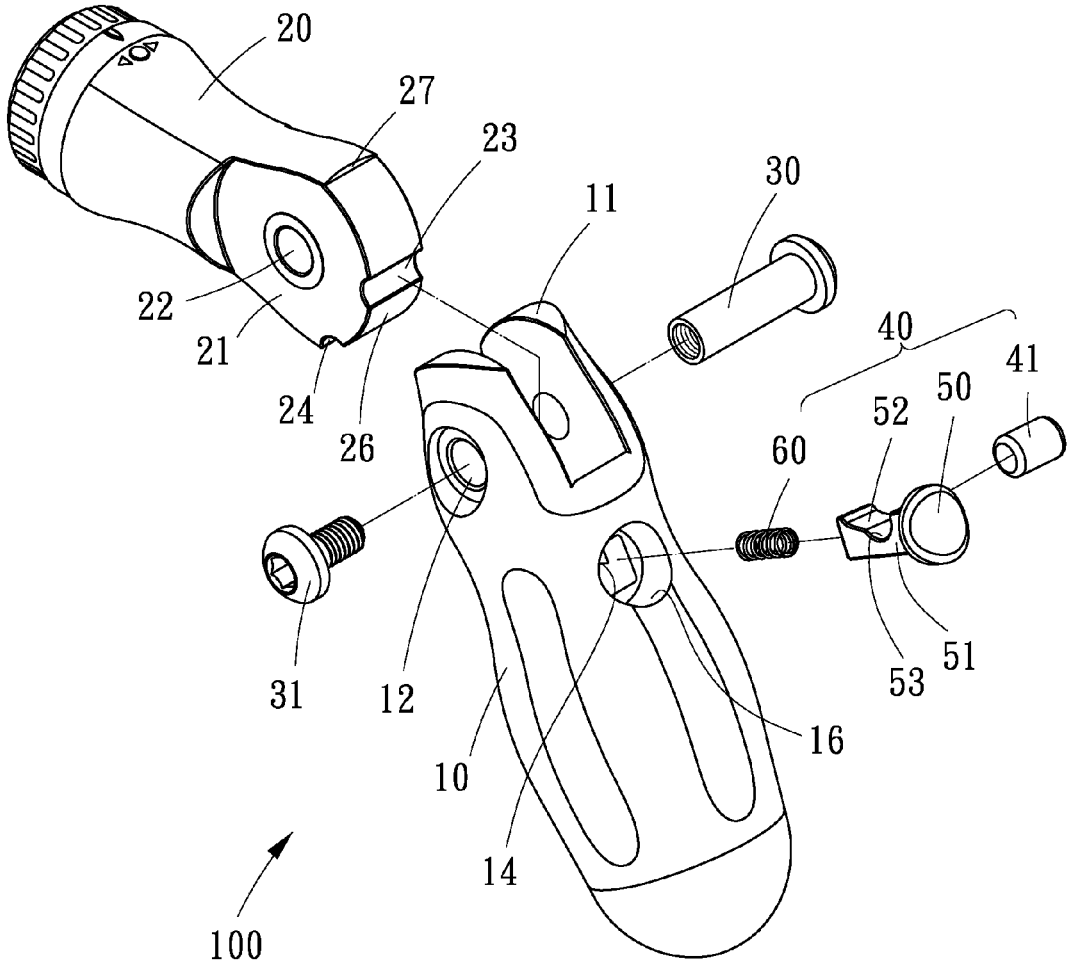
FIG. 1 is an exploded view of a hand tool according to the preferred embodiment of the present invention.
Figure 2:
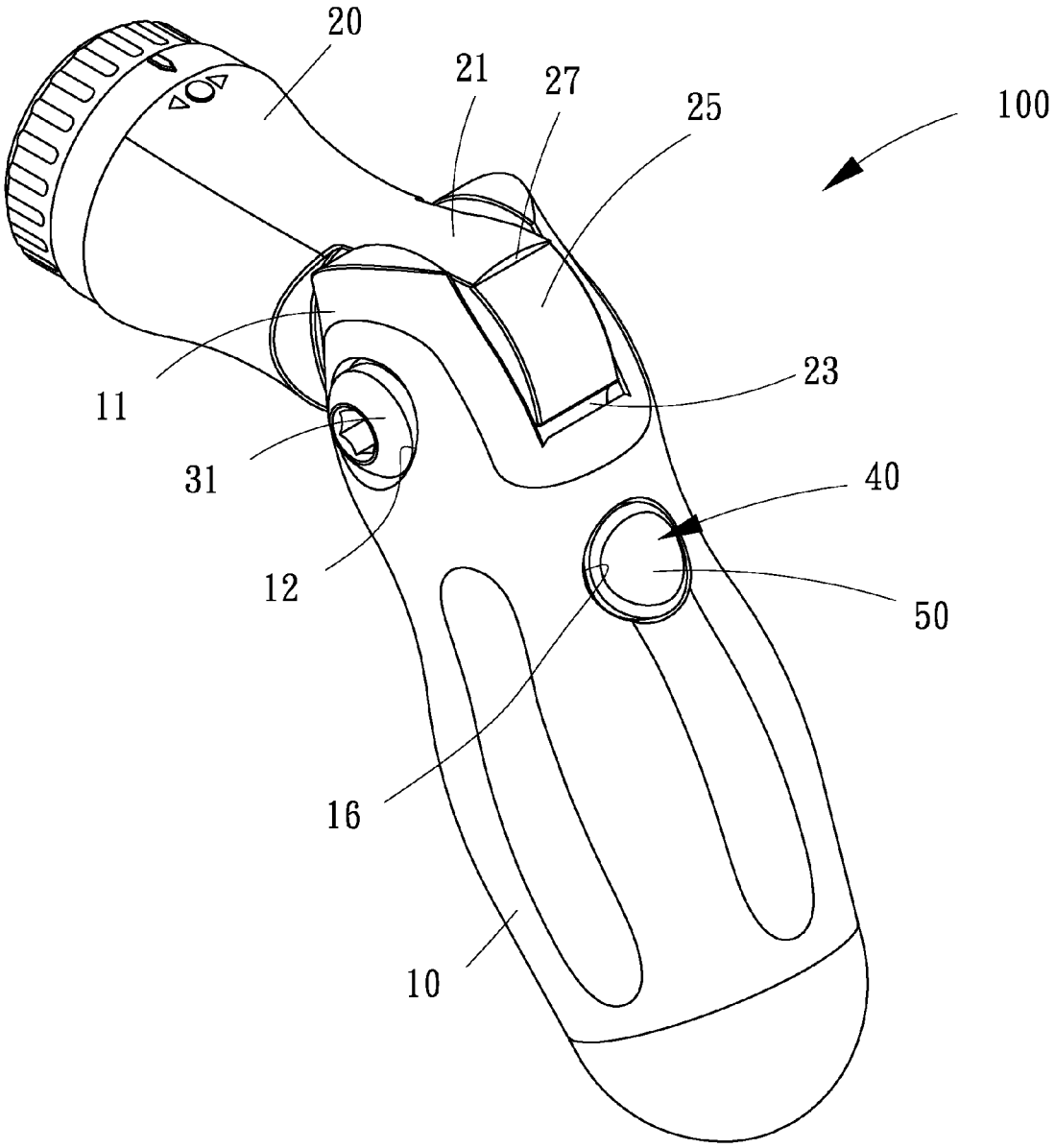
FIG. 2 is a perspective view of the hand tool shown in FIG. 1.
Figure 3:
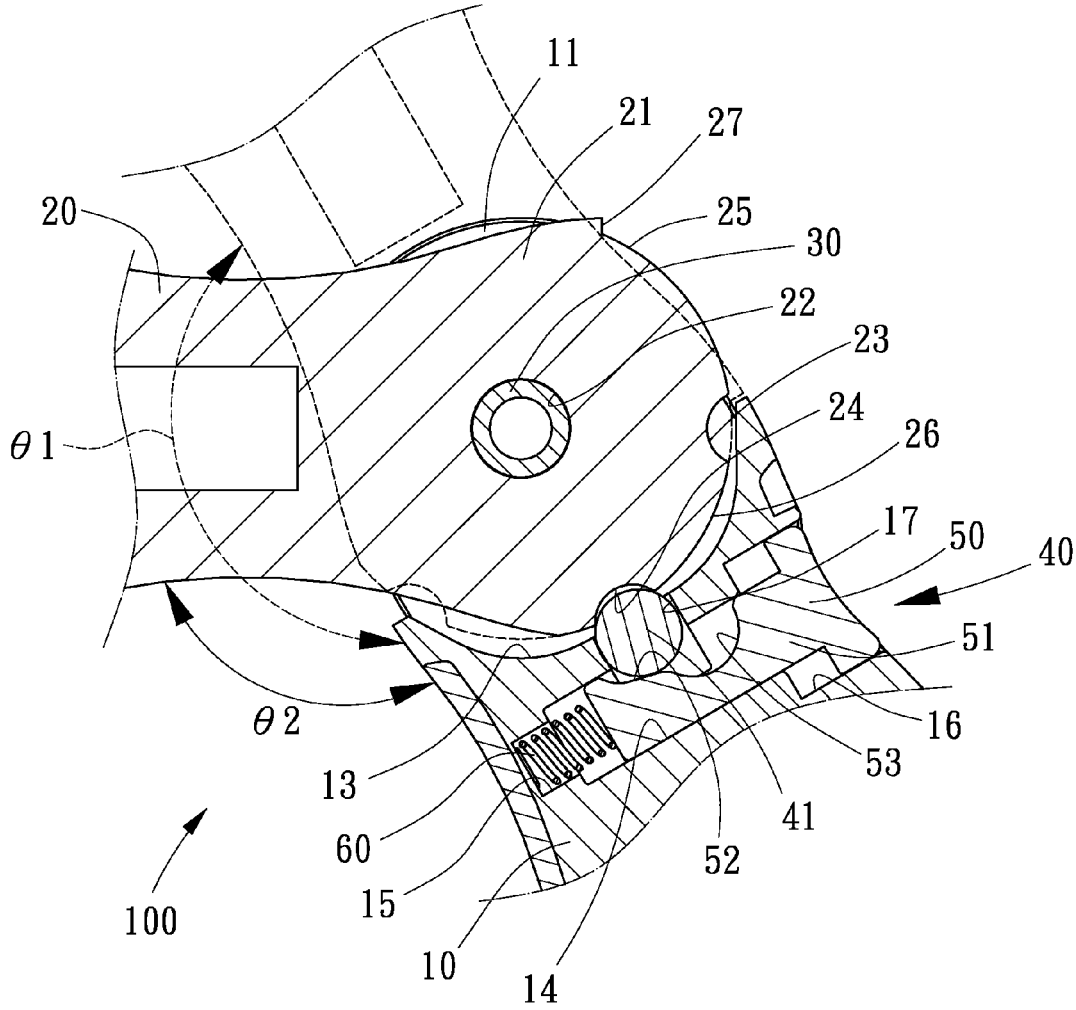
FIG. 3 is a cross-sectional view of the hand tool shown in FIG. 1.

Referring to FIGS. 1 through 3, a hand tool 100 includes a handle 10, a shank 20, a pivot 30 for connecting the shank 20 to the handle 10 pivotally, and a locking unit 40 operable for retaining the shank 20 in a selected one of two angles relative to the handle 10 according to the preferred embodiment of the present invention. The handle 10 is preferably hollow for receiving spare bits or parts for example. The handle 10 includes two ears 11 extending from an end, with a gap 13 defined between the ears 11. A countersink hole 12 is defined in each of the ears 11. The handle 10 includes first, second and third cavities 15, 14 and 16 defined therein. The second cavity 14 is in communication with the first cavity 15. Furthermore, the second cavity 14 is in communication with the gap 13 through a tunnel 17. The third cavity 16 is in communication with the second cavity 14.

The shank 20 includes a flat insert 21 extending from an end and including an aperture 22 defined therein. A bit can be connected to an opposite end of the shank 20. The flat insert 21 is formed with a semicircular edge. First and second recesses 23 and 24 are defined in the semicircular edge of the flat insert 21. The semicircular edge of the flat insert 21 includes a first arched face 25 located near the first recess 23 and a second arched face 26 extending between the first recess 23 and the second recess 24. A stop 27 is formed on the insert 21, next to the first arched face 25.

The pivot 30 is hollow and includes a thread extending on an internal face. There is provided a screw 31. The thread of the screw 31 can be engaged with the thread of the pivot 30.

The locking unit 40 includes a detent 41, a button 50 and a spring 60. The detent 41 is in the form of a circular rod preferably. The detent 41 can however be a ball. The button 50 includes a square rod 51 extending from an end. A shallow recess 52 and a deep recess 53 are defined in a side of the square rod 51.

In assembly, the spring 60 is located in the first cavity 15. The square rod 51 and the detent 41 are located in the second cavity 14. The detent 41 is partially located in the gap 13 through the tunnel 17. The flat insert 21 is located in the gap 13 before the pivot 30 is inserted in the countersink hole 12 and the apertures 22. The thread of the screw 31 is engaged with the thread of the pivot 30 to retain the shank 20 pivotally connected to the handle 10. A first portion of the detent 41 is in contact with the semicircular edge of the insert 21 while an opposite second portion of the detent 41 is in contact with the square rod 51, thus retaining the square rod 51 in the second cavity 14.

Referring to FIG. 3, the shank 20 is retained at an angle θ1 relative to the handle 10 as the first portion of the detent 41 is located in the first recess 23 while the second portion of the detent 41 is located in the shallow recess 52. The angle θ1 is about 175° to 185°, measured from an axis of the shank 20 to an axis of the handle 10.

The shank 20 can be pivoted relative to the handle 10 as the first portion of the detent 41 is located out of the first recess 23 while the second portion of the detent 41 is located in the deep recess 53 by pushing the button 50.

The shank 20 is retained at an angle θ2 relative to the handle 10 as the first portion of the detent 41 is located in the second recess 24 while the second portion of the detent 41 is located in the shallow recess 52. The angle θ2 is about 115° to 145°. The pivotal of the shank 20 on the handle 10 can be limited due to the stop 27 located against a portion of the handle 10 between the ears 11.

Advantageously, the hand tool 100 is efficient for providing only two useful angles so that one of them can be selected efficiently. Furthermore, the hand tool 100 is safe because the arched faces 25 and 26 are made with an adequate width and do not cut a user's finger.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A hand tool including:

a handle including two ears extending from an end;

a shank pivotally connected to the handle and formed with an insert placed between the ears, wherein the insert includes first and second recesses defined therein, a stop formed thereon, a first arched face formed between the stop and the first recess, and a second arched face formed near the second recess; and a locking unit operable for retaining the shank in a selected one of first and second angles relative to the handle, wherein the first angle is about 175° to 185°, wherein the second angle is about 115° to 145°, wherein the locking unit includes:

a detent placed movably in the handle for insertion in a selected one of the first and second recesses; and a button including a square rod with shallow and deep recesses defined therein, wherein the button is placed movably in the handle between a locking position where the shallow recess receives the detent to keep the detent in a selected one of the first and second recesses and a releasing position where the deep recess receives the detent to allow movement of the detent out of any of the first and second recesses.

2. The hand tool according to claim 1, wherein the locking unit includes a spring for biasing the button to the locking position.

3. The hand tool according to claim 2, wherein the wherein the handle includes a first cavity defined therein for receiving the spring and a second cavity for receiving the square rod of the button.

4. The hand tool according to claim 1, wherein the detent is a circular rod.

* * * * *